US009388827B2

(12) United States Patent
Tamaoka et al.

(10) Patent No.: US 9,388,827 B2
(45) Date of Patent: Jul. 12, 2016

(54) BLOWER FAN

(71) Applicant: NIDEC CORPORATION, Kyoto (JP)

(72) Inventors: Takehito Tamaoka, Kyoto (JP); Kazuhiko Fukushima, Kyoto (JP); Kyoko Horise, Kyoto (JP); Shinya Ishigami, Kyoto (JP); Takahiro Nagai, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 353 days.

(21) Appl. No.: 13/942,836

(22) Filed: Jul. 16, 2013

(65) Prior Publication Data

US 2014/0219834 A1 Aug. 7, 2014

(30) Foreign Application Priority Data

Feb. 5, 2013 (JP) ..... 2013-020216

(51) Int. Cl.

*F04D 25/06* (2006.01)
*F04D 29/42* (2006.01)
*F04D 17/16* (2006.01)

(52) U.S. Cl.

CPC ..... *F04D 29/4226* (2013.01); *F04D 17/16* (2013.01); *F04D 25/062* (2013.01); *F04D 29/422* (2013.01); *F04D 29/424* (2013.01); *F04D 29/4213* (2013.01); *F04D 25/0613* (2013.01)

(58) Field of Classification Search

CPC ..... F04D 25/0613; F04D 25/062; F04D 25/0626; F04D 29/057; F04D 29/4206; F04D 29/422; F04D 29/4226; F04D 29/424

USPC ..... 417/423.12, 423.13, 423.14; 415/206

See application file for complete search history.

(56) References Cited

U.S. PATENT DOCUMENTS

| | | | | |
|---|---|---|---|---|
| 2002/0057022 | A1 | 5/2002 | Yamamoto | |
| 2003/0063976 | A1 | 4/2003 | Horng et al. | |
| 2006/0039635 | A1 | 2/2006 | Schmid | |
| 2006/0165525 | A1 | 7/2006 | Kuo et al. | |
| 2007/0194668 | A1 | 8/2007 | Teshima et al. | |
| 2008/0130226 | A1 | 6/2008 | Yamashita et al. | |
| 2009/0230798 | A1 | 9/2009 | Ho | |
| 2012/0121407 | A1 * | 5/2012 | Yamashita | F04D 17/162 415/213.1 |
| 2013/0004114 | A1 * | 1/2013 | Hasegawa | F04D 17/16 384/607 |

FOREIGN PATENT DOCUMENTS

| | | | |
|---|---|---|---|
| JP | 2006-057838 | A | 3/2006 |
| JP | 2008-157216 | A | 7/2008 |

* cited by examiner

*Primary Examiner* — Peter J Bertheaud

(74) *Attorney, Agent, or Firm* — Westerman, Hattori, Daniels & Adrian, LLP

(57) ABSTRACT

A lower plate includes a lower air inlet arranged radially outward of a bearing portion. In a plan view, a plane is divided into four regions by a first straight line which is parallel to an air outlet and crosses a central axis and a second straight line which is perpendicular to the air outlet and crosses the central axis, and one of the four regions in which a tongue portion is arranged is a first region, followed by a second region, a third region, and a fourth region in this order in a rotation direction of the blades. The air outlet is arranged to extend over both the first and fourth regions.

19 Claims, 14 Drawing Sheets

BLOWER FAN

BACKGROUND OF THE INVENTION

1. Field of the Invention

The present invention relates to a slim blower fan installed in a notebook PC or the like.

2. Description of the Related Art

Fans have been arranged inside cases of a variety of electronic devices and household electrical appliances. In the case of notebook PCs and tablet PCs, for example, electronic components, such as CPUs, installed inside cases thereof generate heat, and measures need to be taken against the heat inside the cases. One common measure against the heat is to install centrifugal fans inside the cases to discharge the heat out of the cases.

In recent years, the market has been demanding a reduction in the thickness of the notebook PCs, and there has accordingly been a demand for reductions in the size and thickness of devices installed inside the cases of the notebook PCs. There also has been a demand for a reduction in the thickness of centrifugal fans arranged inside the cases, necessitating a reduction in the axial dimension of blades. However, in the case of a centrifugal fan having blades with a small axial dimension, energy applied by the blades to an air during rotation is small, resulting in a small air volume.

One known method of increasing the air volume is to provide air inlets in both an upper surface and a lower surface of a fan casing of a centrifugal fan as disclosed in JP-A 2008-157216. In addition, it is necessary to increase the rotation speed of the centrifugal fan to increase the air volume.

An increase in the rotation speed of fans, including the centrifugal fans, leads to an increase in a peak value of vibration in each frequency, and then vibrations may exert harmful effects on electronic components. In particular, vibrations are a significant issue for precision machines such as PCs.

Use of a cooling fan including a dynamic pressure bearing as disclosed in JP-A 2006-57838 is considered as a method of reducing vibrations which accompany rotation of the fan. Transfer of vibrations which occur in a rotating body to a case can be reduced by adoption of a dynamic pressure bearing which uses a liquid lubricant, such as an oil, in a bearing portion, since a circumference of a shaft is held by the lubricating fluid. The dynamic pressure bearing as disclosed in JP-A 2006-57838 includes a thrust dynamic pressure bearing extending radially, and this thrust dynamic pressure bearing prevents an excessive lift of the rotating body.

In the case of a fan including the above-described dynamic pressure bearing, the diameter of a rotor cup is necessarily large because the thrust dynamic pressure bearing extending radially is included in the dynamic pressure bearing, and the radial dimension of each blade is decreased relative to the diameter of the rotor cup. That is, a centrifugal fan which adopts a fluid dynamic bearing in order to reduce vibrations which accompany high-speed rotation tends to have a small air volume. That is, in the case of the centrifugal fan which adopts the fluid dynamic bearing, an air volume characteristic and a vibration characteristic stand in a trade-off relationship.

SUMMARY OF THE INVENTION

A blower fan according to a preferred embodiment of the present invention includes a stationary portion, a bearing portion, and a rotating portion supported by the bearing portion to be rotatable with respect to the stationary portion. The rotating portion includes a shaft arranged to extend along a central axis extending in a vertical direction, and inserted in the bearing portion; a blade support portion arranged radially outward of the shaft, and arranged to rotate about the central axis together with the shaft; and a plurality of blades arranged in an annular shape radially outside the blade support portion, and arranged to rotate about the central axis together with the shaft. The stationary portion includes a lower plate arranged to cover the blades from below, and arranged to hold the bearing portion directly or indirectly; an upper plate arranged to cover the blades from above; and a side wall portion arranged to cover the blades from radially outside, and having a lower end portion fixed to the lower plate. Edges of the side wall portion at both ends of an opening of the side wall portion, an edge of the upper plate which extends between the edges of the side wall portion, and an edge of the lower plate which extends between the edges of the side wall portion are arranged to together define an air outlet. An inside surface of the bearing portion, an outside surface of the shaft, and a lubricating oil arranged in a radial gap defined between the inside surface of the bearing portion and the outside surface of the shaft are arranged to together define a radial dynamic pressure bearing portion arranged to generate a fluid dynamic pressure in the lubricating oil. Axially opposed surfaces of the bearing portion and the rotating portion and the lubricating oil arranged in a thrust gap defined between these surfaces are arranged to together define a thrust dynamic pressure bearing portion arranged to generate a fluid dynamic pressure in the lubricating oil in the thrust gap. The lower plate includes a lower air inlet arranged to pass through the lower plate in the vertical direction, and arranged radially outward of the bearing portion. The upper plate includes an upper air inlet arranged to pass through the upper plate in the vertical direction. An inside surface of the side wall portion includes a tongue portion where a radial distance between the inside surface of the side wall portion and any of the blades is shortest. In a plan view, a plane is divided into four regions by a first straight line which is parallel to the air outlet and crosses the central axis and a second straight line which is perpendicular to the air outlet and crosses the central axis, and one of the four regions in which the tongue portion is arranged is a first region, followed by a second region, a third region, and a fourth region in this order in a rotation direction of the blades. The air outlet is arranged to extend over both the first and fourth regions. At least a portion of the lower air inlet is arranged in the fourth region. A radial distance between the central axis and a radially outer edge of the lower air inlet is arranged to be longest in the fourth region.

A blower fan according to a preferred embodiment of the present invention is able to achieve a reduction in vibrations and an increase in air volume.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
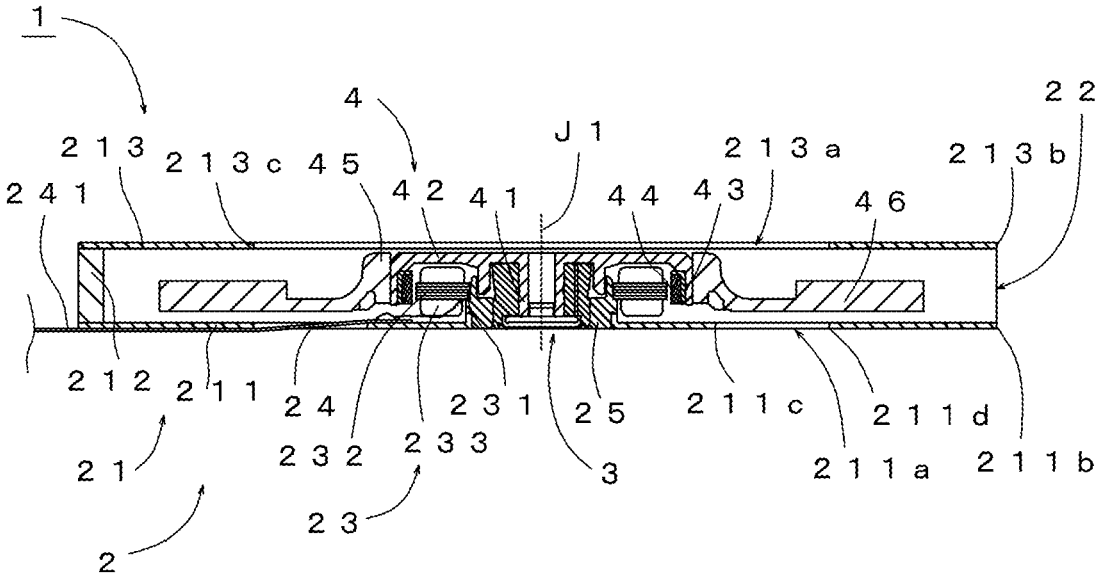
FIG. 1 is a cross-sectional view of a blower fan according to a preferred embodiment of the present invention.

It is assumed herein that an upper side and a lower side in a direction parallel to a central axis J1 of a blower fan illustrated in FIG. 1 are referred to simply as an upper side and a lower side, respectively. Note that a vertical direction assumed herein may not necessarily correspond with a vertical direction of the blower fan when the blower fan is actually installed in a device. It is also assumed herein that a circumferential direction about the central axis J1 is simply referred to by the term "circumferential direction", "circumferential", or "circumferentially", that radial directions centered on the central axis J1 are simply referred to by the term "radial direction", "radial", or "radially", and that the direction parallel to the central axis J1 is simply referred to by the term "axial direction", "axial", or "axially".

FIG. 1 is a cross-sectional view of a blower fan 1 according to a preferred embodiment of the present invention. The blower fan 1 is a centrifugal fan. The blower fan 1 is, for example, installed in a notebook personal computer (hereinafter referred to as a "notebook PC"), and used to cool devices inside a case of the notebook PC.

The blower fan 1 includes a stationary portion 2, a bearing portion 3, and a rotating portion 4. The rotating portion 4 is centered on the central axis J1 extending in the vertical direction. The rotating portion 4 is supported by the bearing portion 3 to be rotatable with respect to the stationary portion 2.

The stationary portion 2 includes a lower plate 211, a side wall portion 212, an upper plate 213, and an air outlet 22. The lower plate 211 is arranged to cover a plurality of blades 46 of the rotating portion 4 from below. The blades 46 will be described in detail below.

The lower plate 211 is arranged to hold the bearing portion 3. In the present preferred embodiment, the bearing portion 3 is fixed to the lower plate 211 through a bushing 25 of the stationary portion 2. The bushing 25 will be described below. That is, the lower plate 211 is arranged to indirectly hold the bearing portion 3. Note, however, that the lower plate 211 may be arranged to directly hold the bearing portion 3. The lower plate 211 includes a lower air inlet 211*a* arranged to pass through the lower plate 211 in the vertical direction, and arranged in a substantially annular shape. A radially inner edge 211*c* of the lower air inlet 211*a* is an edge of a substantially annular surface facing radially outward. Meanwhile, a radially outer edge 211*d* of the lower air inlet 211*a* is an edge of a substantially annular surface facing radially inward. The lower air inlet 211*a* is arranged radially outward of the bearing portion 3.

The side wall portion 212 is arranged to cover the rotating portion 4 from radially outside. A lower end portion of the side wall portion 212 is fixed to the lower plate 211. The upper plate 213 is arranged to cover the blades 46 of the rotating portion 4 from above. In the present preferred embodiment, the upper plate 213 is arranged to cover the entire rotating portion 4 from above. Note, however, that a portion of the rotating portion 4 may be arranged to project above the upper plate 213 through an upper air inlet 213*a*, which will be described below. The upper plate 213 includes the upper air inlet 213*a*, which is substantially circular and is arranged to pass through the upper plate 213 in the vertical direction. An edge 213*c* of the upper air inlet 213*a* is arranged radially inward of an outside surface of each of the blades 46, that is, a radially outer end portion of each of the blades 46. The upper plate 213 is fixed to an upper end portion of the side wall portion 212. In the stationary portion 2, the lower plate 211, the side wall portion 212, and the upper plate 213 are arranged to together define a housing 21. Both the edge 213*c* of the upper air inlet 213*a* and the radially outer edge 211*d* of the lower air inlet 211*a* are arranged radially inward of the radially outer end portion of each of the blades 46. In the case where an edge of an air inlet is arranged radially outward of a plurality of blades, there is generally a possibility that a backflow of an air will occur, which may lead to reductions in both air volume and static pressure. However, the blower fan 1 according to the present preferred embodiment is able to prevent a backflow of an air.

Each of the lower and upper plates 211 and 213 is made of a metal, such as an aluminum alloy or stainless steel, and is in the shape of a thin plate. The side wall portion 212 is molded of a resin. The lower end portion of the side wall portion 212 and a periphery portion of the lower plate 211 are fastened to each other by an insert molding process. The upper plate 213 is fixed to a top portion of the side wall portion 212 through screws. Note, however, that there are various fixing methods which are adoptable, and that use of the aforementioned fixing methods is not essential to the present invention.

The air outlet 22 is defined by edges 212*a* (see FIG. 5) of the side wall portion 212 at both ends of an opening of the side wall portion 212, an edge 213*b* of the upper plate 213 which extends between the edges 212*a* of the side wall portion 212, and an edge 211*b* of the lower plate 211 which extends between the edges 212*a* of the side wall portion 212.

The stationary portion 2 further includes a stator 23 and a circuit board 24. The stator 23 is annular and centered on the central axis J1, and is arranged radially outward of the bearing portion 3. The stator 23 includes an annular core back 231, a plurality of teeth 232, and coils 233. The teeth 232 are arranged to project radially outward from the core back 231. Each coil 233 is defined by a conducting wire wound around a separate one of the teeth 232.

The circuit board 24 is arranged below the coils 233 and above the lower plate 211. In the present preferred embodiment, the circuit board 24 is arranged on an upper surface of the lower plate 211. Lead wires from the coils 233 are electrically connected to the circuit board 24. The circuit board 24 is a flexible printed circuit (FPC) board. The circuit board 24 includes a connection portion 241 arranged to extend out of the blower fan 1. The connection portion 241 is a portion used to connect the blower fan 1 with an external device. The connection portion 241 according to the present preferred embodiment is an extension portion of the flexible printed circuit board. Although the circuit board 24 according to the present preferred embodiment is the flexible printed circuit board, the circuit board 24 may be a rigid board in other preferred embodiments of the present invention. In the case where the circuit board 24 is the rigid board, the connection portion 241 may be, for example, a lead wire.

The rotating portion 4 includes a shaft 41, a rotor hub 42, a yoke 43, a rotor magnet 44, a blade support portion 45, and the blades 46. The shaft 41 is arranged to extend along the central axis J1. The rotor hub 42 is arranged to extend radially outward from an upper end portion of the shaft 41. The rotor hub 42 is a portion which is substantially in the shape of a covered cylinder. The rotor hub 42 and the shaft 41 are defined integrally with each other according to the present preferred embodiment. Note, however, that the rotor hub 42 and the shaft 41 may be defined by separate members.

The blade support portion 45 is a resin member which is substantially cylindrical and centered on the central axis J1. The blade support portion 45 is arranged radially outward of the shaft 41, and is arranged to rotate about the central axis J1 together with the shaft 41. The yoke 43 is substantially cylindrical and centered on the central axis J1. The yoke 43 is made of a soft magnetic material. The yoke 43 is arranged radially inward of the blade support portion 45. The rotor magnet 44 is substantially cylindrical and centered on the central axis J1, and is fixed to an inside surface of the yoke 43. An inside surface of the rotor magnet 44 is arranged radially opposite an outside surface of each of the teeth 232. A current is supplied to the stator 23 to produce a torque centered on the central axis J1 between the rotor magnet 44 and the stator 23.

The blades 46 are arranged in an annular shape radially outside the blade support portion 45. In addition, the blades 46 are arranged at regular intervals in a circumferential direction. Note, however, that the blades 46 may be arranged at irregular intervals in the circumferential direction. The blades 46 are arranged to rotate about the central axis J1 together with the shaft 41. The blade support portion 45 and the blades 46 are defined as a unitary resin member. Rotation of the blades 46 causes an air to be sucked into the housing 21 through each of the upper and lower air inlets 213*a* and 211*a* and to be discharged through the air outlet 22.

Figure 2:
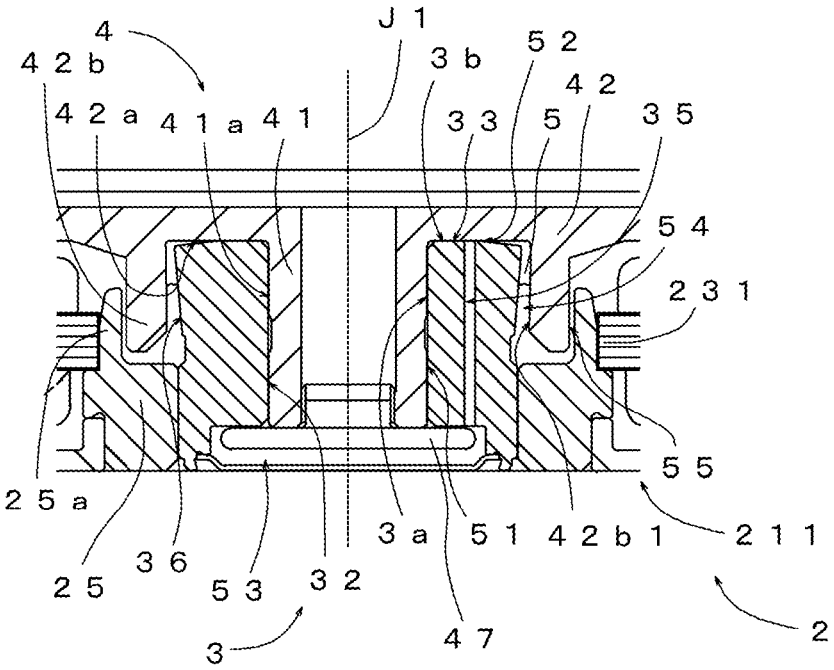
FIG. 2 is a cross-sectional view of a bearing portion and its vicinity according to the preferred embodiment of the present invention.

FIG. 2 is a cross-sectional view of the bearing portion 3 and its vicinity. The bearing portion 3 is a fluid dynamic bearing apparatus arranged to generate a fluid dynamic pressure in a lubricating oil 5. The lubricating oil 5 is arranged in a gap defined between the bearing portion 3 and the rotating portion 4. Provision of the bearing portion 3, i.e., the fluid dynamic bearing apparatus, in the blower fan 1 contributes to reducing vibrations which accompany rotation of the blower fan 1. The bearing portion 3 is able to reduce the vibrations even when a rotation rate of the blower fan 1 is small, but the bearing portion 3 is able to reduce the vibrations more effectively when the rotation rate of the blower fan 1 is large.

The rotating portion 4 is supported through the bearing portion 3 to be rotatable about the central axis J1 with respect to the stationary portion 2. The bearing portion 3 has a bottom and is substantially cylindrical and centered on the central axis J1. The shaft 41 is inserted in the bearing portion 3. The lubricating oil 5 is arranged in a radial gap 51 defined between an inside surface 32 of the bearing portion 3 and an outside surface 41*a* of the shaft 41. The inside surface 32 of the bearing portion 3, the outside surface 41*a* of the shaft 41, and the lubricating oil 5 are arranged to together define a radial dynamic pressure bearing portion 3*a*.

Figure 3:
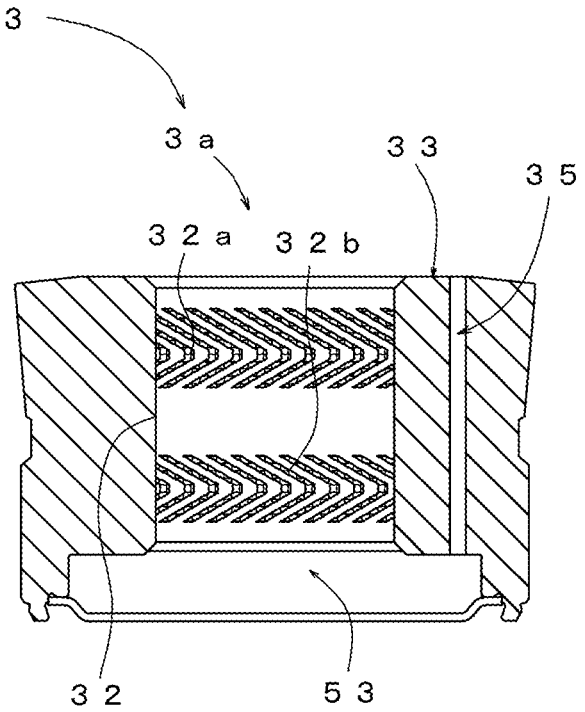
FIG. 3 is a cross-sectional view of the bearing portion.

FIG. 3 is a cross-sectional view of the bearing portion 3. An upper portion of the inside surface 32 of the bearing portion 3 includes a first radial dynamic pressure groove array 32*a* arranged, for example, in a herringbone pattern. In addition, a lower portion of the inside surface 32 of the bearing portion 3 includes a second radial dynamic pressure groove array 32*b* arranged, for example, in a herringbone pattern. That is, the radial dynamic pressure bearing portion 3*a* includes the first and second radial dynamic pressure groove arrays 32*a* and 32*b*. Rotation of the rotating portion 4 causes the radial dynamic pressure bearing portion 3*a* to generate a fluid dynamic pressure in the lubricating oil 5 through the first and second radial dynamic pressure groove arrays 32*a* and 32*b*. While the blower fan 1 is rotating, the shaft 41 is radially supported by the radial dynamic pressure bearing portion 3*a*.

Figure 4:
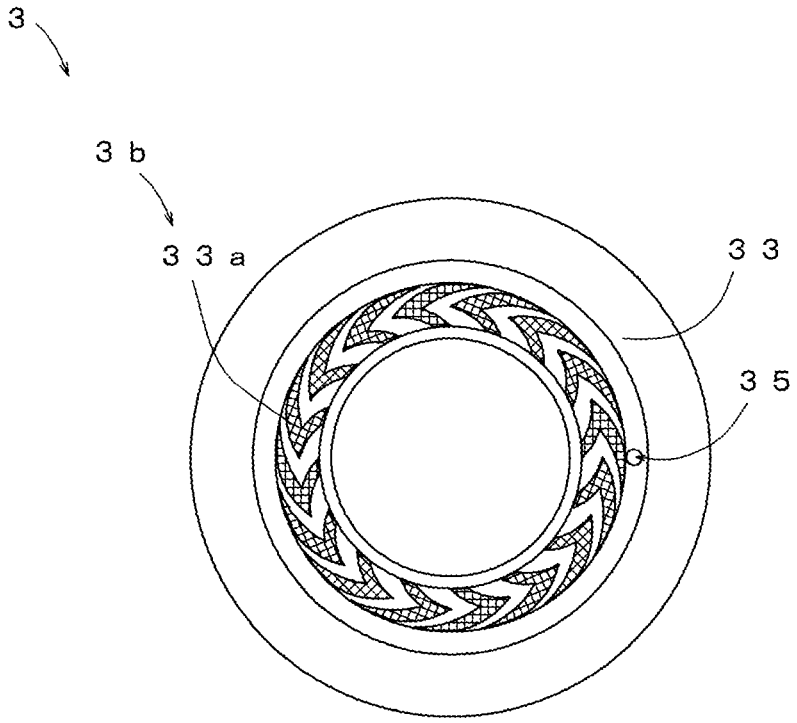
FIG. 4 is a plan view of the bearing portion.

An upper surface 33 of the bearing portion 3 is arranged axially opposite a lower surface 42*a* of the rotor hub 42. The lubricating oil 5 is arranged in a thrust gap 52 defined between the upper surface 33 of the bearing portion 3 and the lower surface 42*a* of the rotor hub 42. The upper surface 33 of the bearing portion 3, the lower surface 42*a* of the rotor hub 42, and the lubricating oil 5 are arranged to together define a thrust dynamic pressure bearing portion 3*b*. FIG. 4 is a plan view of the bearing portion 3. The upper surface 33 of the bearing portion 3 includes a thrust dynamic pressure groove array 33*a* arranged, for example, in a spiral pattern. The rotation of the rotating portion 4 causes the thrust dynamic pressure bearing portion 3*b* to generate a fluid dynamic pressure in the lubricating oil 5 through the thrust dynamic pressure groove array 33*a*. While the blower fan 1 is rotating, the rotor hub 42 is axially supported by the thrust dynamic pressure bearing portion 3*b*.

The bearing portion 3 includes a circular lower space 53 arranged to extend radially outward from a lower end of a hole in which the shaft 41 is inserted. The lubricating oil 5 is arranged in the lower space 53. The bearing portion 3 further includes a communicating hole 35 arranged to bring the lower space 53 and the thrust gap 52 defined between the upper surface 33 of the bearing portion 3 and the lower surface 42*a* of the rotor hub 42 into communication with each other. The communicating hole 35 is arranged to pass through the bearing portion 3 in the vertical direction. Provision of the communicating hole 35 enables the lubricating oil 5 to circulate in the gap defined between the bearing portion 3 and the rotating portion 4 while the blower fan 1 is rotating. A thrust plate 47 arranged to extend radially outward from a lower end portion of the shaft 41 is accommodated in the lower space 53.

The rotor hub 42 includes a hub cylindrical portion 42*b* which is cylindrical and is arranged to extend axially downward from the lower surface 42*a* of the rotor hub 42. A single seal gap 54 is defined between an inside surface 42*b*1 of the hub cylindrical portion 42*b* and an upper portion of an outside surface 36 of the bearing portion 3. The seal gap 54 is arranged to gradually increase in radial width with decreasing height. The seal gap 54 is an annular space centered on the central axis J1. The lubricating oil 5 is held in the seal gap 54 through capillary action. As a surface of the lubricating oil 5 in the seal gap 54 moves downward, the surface of the lubricating oil 5 increases in surface area, and receives a greater upward pressure caused by an atmospheric pressure. That is, the seal gap 54 makes downward movement of the surface of the lubricating oil 5 less likely to occur.

In the blower fan 1, the radial gap 51, the thrust gap 52, the lower space 53, and the seal gap 54 are arranged to together define a single continuous bladder structure, and the lubricating oil 5 is arranged continuously in this bladder structure. Referring to FIG. 2, the surface of the lubricating oil 5 in the seal gap 54 is the sole surface of the lubricating oil 5 in the blower fan 1.

The stationary portion 2 further includes the bushing 25, which is substantially annular. An inside surface of the bushing 25 is fixed to a lower portion of the outside surface 36 of the bearing portion 3. The bushing 25 is a metallic member defined by a cutting process. The inside surface of the bushing 25 is fixed to a lower region of the outside surface of the bearing portion 3. In addition, an outside surface of the bushing 25 is fixed to an inside surface of the lower plate 211. That is, in the present preferred embodiment, the lower plate 211 is arranged to indirectly hold the bearing portion 3 through the bushing 25.

The bushing 25 includes a bushing cylindrical portion 25*a* which is cylindrical and is arranged to extend axially upward from an upper surface of the bushing 25. An annular labyrinth gap 55 extending in an axial direction is defined between an inside surface of the bushing cylindrical portion 25*a* and an outside surface of the hub cylindrical portion 42*b*. The labyrinth gap 55 is arranged radially outward of the seal gap 54. The labyrinth gap 55 is arranged to have a radial width smaller than that of an opening of the seal gap 54. Provision of the labyrinth gap 55 in the blower fan 1 contributes to reducing the likelihood that an air including an evaporated portion of the lubricating oil 5 will travel from the seal gap 54 to an outside of the bearing portion 3. This contributes to reducing evaporation of the lubricating oil 5 out of the bearing portion 3. Moreover, the provision of the labyrinth gap 55 in the blower fan 1 contributes to reducing the likelihood that dust, dirt, or the like will enter into the lubricating oil 5.

In the present preferred embodiment, the hub cylindrical portion 42*b* is a portion of the rotor hub 42. Note, however, that the hub cylindrical portion 42*b* and the rotor hub 42 may be defined by separate members. In this case, the hub cylindrical portion 42*b* is fixed to the rotor hub 42, and the labyrinth gap 55 is defined between the inside surface of the bushing cylindrical portion 25*a* and the outside surface of the hub cylindrical portion 42*b* separate from the rotor hub 42.

An inside surface of the core back 231 of the stator 23 is fixed to an outside surface of the bushing cylindrical portion 25*a*. In the blower fan 1 according to the present preferred embodiment, the seal gap 54, the labyrinth gap 55, and the core back 231 are arranged to radially overlap with one another. There has been a demand for a reduction in the thickness of blower fans, and the above arrangement achieves a greater reduction in the thickness of the blower fan 1.

Figure 5:
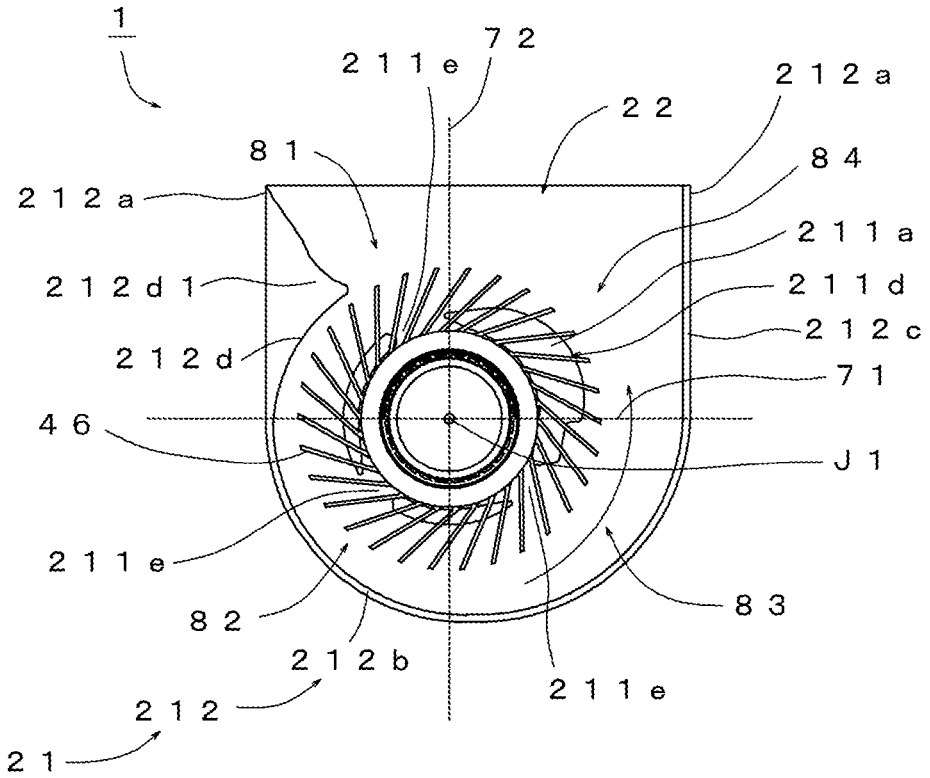
FIG. 5 is a plan view of the blower fan.

FIG. 5 is a plan view of the blower fan 1. For the sake of convenience, the upper plate 213 and the circuit board 24 are not shown in FIG. 5. The blades 46 are arranged to rotate in a counterclockwise direction in FIG. 5. A rotation direction of the blades 46 and a direction opposite to the rotation direction of the blades 46 will be hereinafter referred to simply as a "rotation direction" and a "counter-rotation direction", respectively. The rotation of the blades 46 causes an air to be sucked into the housing 21 through each of the upper air inlet 213*a* (not shown in FIG. 5) and the lower air inlet 211*a* and to be discharged through the air outlet 22.

Referring to FIG. 5, the side wall portion 212 includes a first side wall portion 212*b*, a second side wall portion 212*c*, and a third side wall portion 212*d*. Each of the first, second, and third side wall portions 212*b*, 212*c*, and 212*d* is arranged to extend in parallel with the central axis J1 in the vertical direction. The first side wall portion 212*b* is arranged on an opposite side of the central axis J1 with respect to the air outlet 22.

The first side wall portion 212*b* is arranged to extend in a curve along outer circumferences of the blades 46. The first side wall portion 212*b* is arranged to extend in a circumferential direction about an axis extending in the vertical direction and displaced from the central axis J1. The second side wall portion 212*c* is arranged to extend in the rotation direction from the first side wall portion 212*b* while becoming more distant from the central axis J1. The third side wall portion 212*d* is arranged to extend in the counter-rotation direction from the first side wall portion 212*b* while approaching the central axis J1.

An edge of the second side wall portion 212*c* at an end portion thereof on a forward side in the rotation direction and an edge of the third side wall portion 212*d* at an end portion thereof on a rearward side in the rotation direction are the edges 212*a* of the side wall portion 212 at both ends of the opening of the side wall portion 212. That is, both the edge of the second side wall portion 212*c* at the end portion thereof on the forward side in the rotation direction and the edge of the third side wall portion 212*d* at the end portion thereof on the rearward side in the rotation direction are portions of an edge defining the air outlet 22.

The third side wall portion 212*d* includes a tongue portion 212*d*1 arranged to project toward the second side wall portion 212*c*. In the present preferred embodiment, the radial distance between an inside surface of the side wall portion 212 and the outside surface of any of the blades 46 is shortest at the tongue portion 212*d*1. That is, the inside surface of the side wall portion 212 includes the tongue portion 212*d*1 where the radial distance between the inside surface of the side wall portion 212 and any of the blades 46 is shortest.

Figure 6:
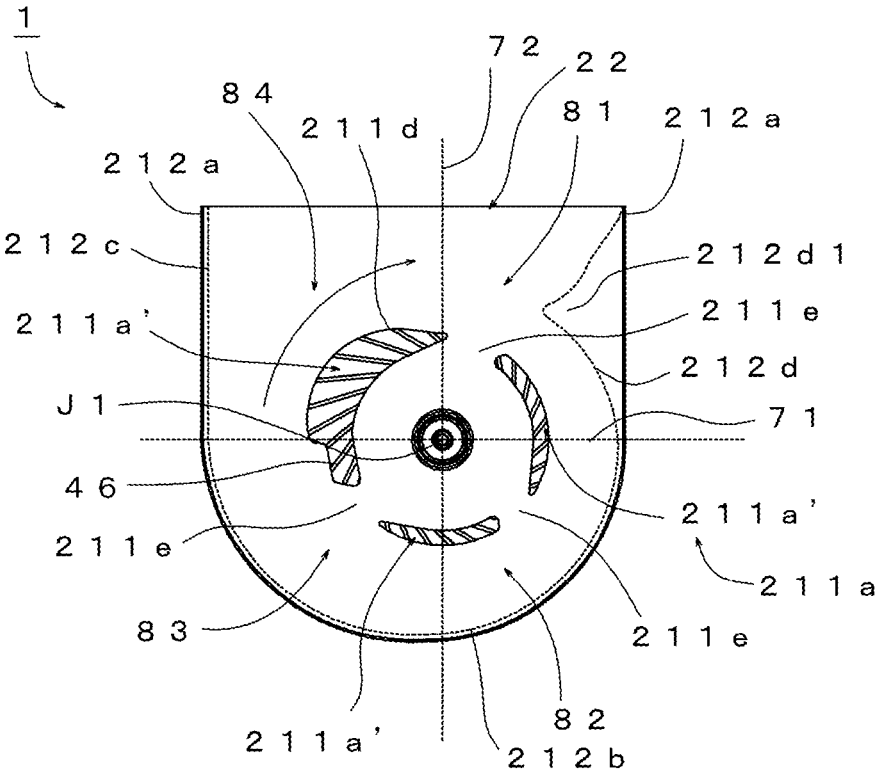
FIG. 6 is a bottom view of the blower fan.

Chain lines 71 and 72 passing through the central axis J1 in FIG. 5 are, respectively, a first straight line 71 which is parallel to the air outlet 22 and crosses the central axis J1 in a plan view of the blower fan 1, and a second straight line 72 which is perpendicular to the air outlet 22 and crosses the central axis J1 in the plan view of the blower fan 1. The same is true of FIG. 6. FIG. 6 is a bottom view of the blower fan 1.

It is assumed here that a plane is divided into four regions by the first and second straight lines 71 and 72, and that one of the four regions in which the tongue portion 212*d*1 is arranged is a first region 81, followed by a second region 82, a third region 83, and a fourth region 84 in this order in the rotation direction. The air outlet 22 is arranged to extend over both the first and fourth regions 81 and 84.

In the blower fan 1, the radial distance between the central axis J1 and the radially outer edge 211*d* of the lower air inlet 211*a* is longest in the fourth region 84 out of the first to fourth regions 81, 82, 83, and 84.

In the blower fan 1, the amount of air sucked in through the upper and lower air inlets 213*a* and 211*a* during the rotation of the blades 46 increases in the rotation direction with the tongue portion 212*d*1 as a starting point. In the fourth region 84, the air is discharged through the air outlet 22 along an inside surface of the second side wall portion 212*c*.

In a common blower fan, in a region extending from the tongue portion in the first region to a far end of the third region in the rotation direction, the amount of air sucked in depends on the radial distance between the blades and the side wall portion and the axial distance between the upper surface of the lower plate and the lower surface of the upper plate. In particular, in the case of a slim blower fan, the amount of air sucked in in the first to third regions is especially small. Moreover, in the blower fan, the amount of air discharged through the air outlet in the first region is small.

In the present preferred embodiment, however, the radial distance between the central axis J1 and the radially outer edge 211*d* of the lower air inlet 211*a* is longest in the fourth region 84 out of the first to fourth regions 81, 82, 83, and 84. The amount of air sucked in in the fourth region 84 is accordingly increased. This overcomes the problem of a limited amount of air discharged through the air outlet 22 in the first region 81, leading to an increased air volume of the blower fan 1.

Therefore, the blower fan 1 achieves a reduction in vibrations by including the fluid dynamic bearing apparatus, and moreover achieves an increase in the air volume despite inclusion of the fluid dynamic bearing apparatus.

In a common blower fan including the upper and lower air inlets, the lower plate is arranged to hold the bearing portion radially inside the lower air inlet, and therefore, the area of an opening of the lower air inlet is smaller than the area of an opening of the upper air inlet. Accordingly, the amount of air sucked in through the lower air inlet is smaller than the amount of air sucked in through the upper air inlet. Furthermore, as mentioned above, in a slim blower fan in particular, the amount of air sucked in in the first to third regions is especially small. Therefore, a large amount of air is not expected to be sucked in through the lower air inlet in the first to third regions. In other words, a large amount of air is expected to be sucked in through the lower air inlet in the fourth region.

In the present preferred embodiment, the radial distance between the central axis J1 and the radially outer edge 211*d* of the lower air inlet 211*a* is longest in the fourth region 84 out of the first to fourth regions 81, 82, 83, and 84. The amount of air sucked in through the lower air inlet 211*a* in the fourth region 84 is accordingly increased. Moreover, a sufficient rigidity of the lower plate 211 is secured because the total area of openings of the lower air inlet 211*a* in the first to third regions 81, 82, and 83, where a large amount of air is not expected to be sucked in, is not increased. This leads to a more effective reduction in noise of the blower fan 1.

In the present preferred embodiment, the lower air inlet 211*a* is arranged to extend over all of the first to fourth regions 81, 82, 83, and 84. Note, however, that no portion of the lower air inlet 211*a* may be arranged in each of the first to third regions 81, 82, and 83. For example, the lower air inlet 211*a* may be arranged only in the fourth region 84. Alternatively, portions of the lower air inlet 211*a* may be arranged in the fourth region 84 and one or two of the first to third regions 81, 82, and 83.

A portion of the lower plate 211 which is radially inward of the lower air inlet 211*a* and a portion of the lower plate 211 which is radially outward of the lower air inlet 211*a* are joined to each other through a plurality of ribs 211*e*. Therefore, the substantially annular lower air inlet 211*a* may be considered to be a collection of a plurality of air inlet portions 211*a*' each of which is substantially in the shape of a circular arc and which are arranged in the circumferential direction. In the present preferred embodiment, each air inlet portion 211*a*' is substantially in the shape of a circular arc. Note, however, that each air inlet portion 211*a*' may not necessarily be substantially in the shape of a circular arc.

The air inlet portion 211*a*' having a portion thereof arranged in the fourth region 84 is arranged to extend over both the third and fourth regions 83 and 84. That is, an end portion of the air inlet portion 211*a*' having a portion thereof arranged in the fourth region 84 on the rearward side in the rotation direction is arranged in the third region 83. Moreover, the air inlet portion 211*a*' having a portion thereof arranged in the fourth region 84 is arranged to extend over both the first and fourth regions 81 and 84. That is, an end portion of the air inlet portion 211*a*' having a portion thereof arranged in the fourth region 84 on the forward side in the rotation direction is arranged in the first region 81. The ribs 211*e* are arranged in the first to third regions 81, 82, and 83, and the lower plate 211 includes no rib 211*e* in the fourth region 84. The amount of air sucked in through the lower air inlet 211*a* in the fourth region 84 is thereby increased. This leads to an increased air volume of the blower fan 1. Note that, although the number of ribs 211*e* is three in the present preferred embodiment, the number of ribs 211*e* may not necessarily be three.

Furthermore, in the present preferred embodiment, the air inlet portion 211*a*' having a portion thereof arranged in the fourth region 84 is arranged to have the greatest circumferential dimension of all the air inlet portions 211*a*' of the lower air inlet 211*a*. This leads to a more effective increase in the air volume of the blower fan 1.

The air inlet portion 211*a*' having a portion thereof arranged in the fourth region 84 is arranged to have the greatest radial width of all the air inlet portions 211*a*' of the lower air inlet 211*a*. This arrangement also leads to a more effective increase in the air volume of the blower fan 1.

Figure 7:
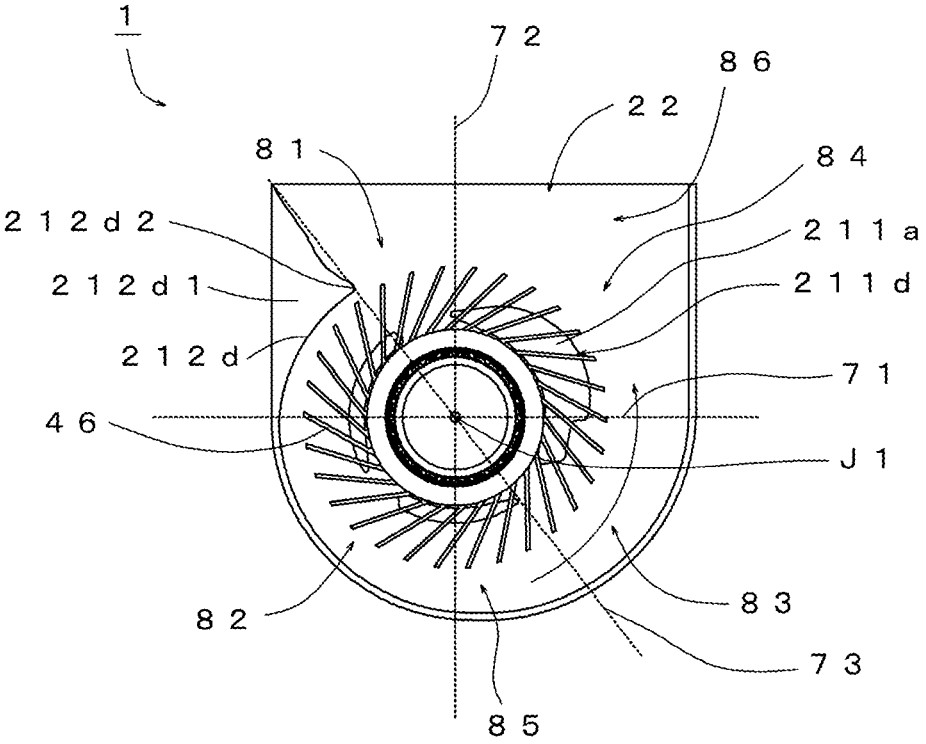
FIG. 7 is a plan view of the blower fan.

The tongue portion 212*d*1 includes a proximity point 212*d*2 where the tongue portion 212*d*1 is closest to the outer end portion of any of the blades 46. In FIG. 7, a chain line 73 passing through the central axis J1 is a third straight line 73 which joins the proximity point 212*d*2 and the central axis J1 in the plan view of the blower fan 1. It is assumed here that the plane is divided into two regions by the third straight line 73, and that, of the two regions, a region in which the tongue portion 212*d*1 is arranged is assumed to be a fifth region 85, and the other region is assumed to be a sixth region 86. That is, the tongue portion 212*d*1 is arranged in both the first and fifth regions 81 and 85. Note that, for the sake of convenience, the upper plate 213 and the circuit board 24 are not shown in FIG. 7 as well.

The end portion of the air inlet portion 211*a*' having a portion thereof arranged in the fourth region 84 on the forward side in the rotation direction is arranged in both the first and sixth regions 81 and 86. That is, the end portion of the air inlet portion 211*a*' having a portion thereof arranged in the fourth region 84 on the forward side in the rotation direction is arranged in the sixth region 86. This contributes to reducing the likelihood that an air sucked in through the air inlet portion 211*a*' having a portion thereof arranged in the fourth region 84 will blow into the fifth region 85 beyond the tongue portion 212*d*1. Accordingly, the air is efficiently discharged through the air outlet 22.

If the end portion of the air inlet portion 211*a*' having a portion thereof arranged in the fourth region 84 on the forward side in the rotation direction were arranged in the fifth region 85, a greater amount of air would blow into the fifth region 85, and a reduction in the air volume and an increase in noise might result. However, a reduction in noise is achieved by arranging the end portion of the air inlet portion 211*a*' having a portion thereof arranged in the fourth region 84 on the forward side in the rotation direction in the sixth region 86.

Figure 8:
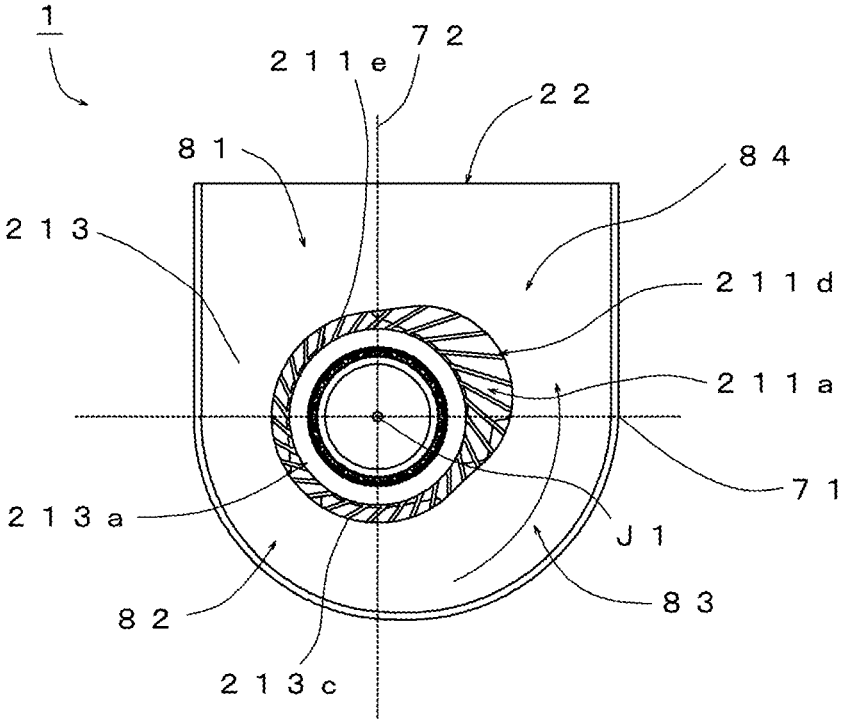
FIG. 8 is a plan view of the blower fan.

Furthermore, referring to FIG. 8, in the present preferred embodiment, the circumferential position of a point on the edge 213*c* of the upper air inlet 213*a* where the distance between the edge 213*c* of the upper air inlet 213*a* and the central axis J1 is longest is arranged to axially coincide with the circumferential position of a point on the radially outer edge 211*d* of the lower air inlet 211*a* in the fourth region 84 where the distance between the radially outer edge 211*d* and the central axis J1 is longest. That is, in the plan view of the blower fan 1, the position of a point where the radial distance between the central axis J1 and the edge 213*c* of the upper air inlet 213*a* is longest coincides with the position of a point where the radial distance between the central axis J1 and the radially outer edge 211*d* of the lower air inlet 211*a* is longest. Therefore, in the present preferred embodiment, an air is efficiently sucked in through the upper air inlet 213*a* as well.

Figure 9:
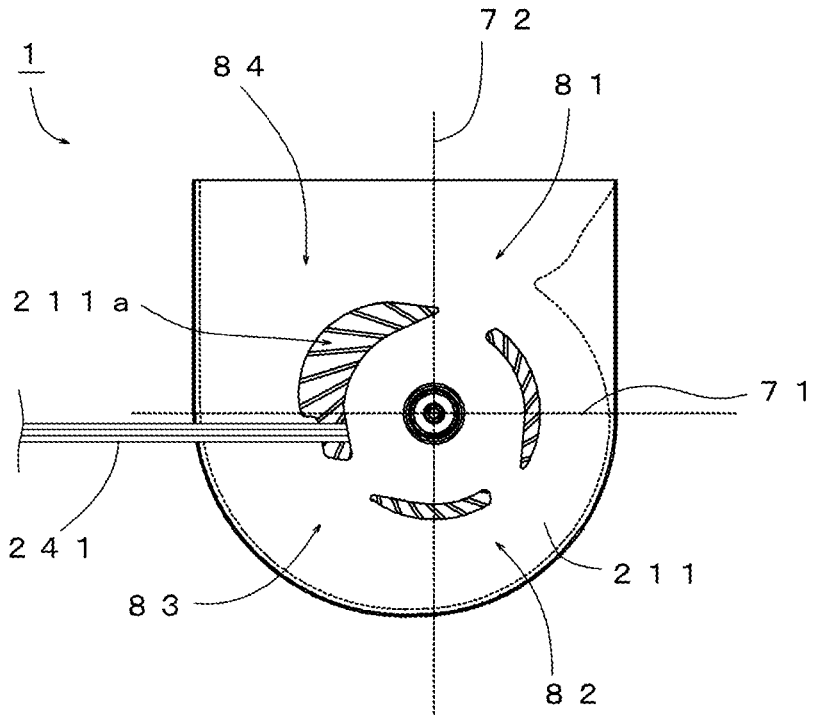
FIG. 9 is a bottom view of the blower fan.

Referring to FIG. 9, the connection portion 241 is drawn out downwardly through the lower air inlet 211*a* from above the lower plate 211 in the third region 83. As described above, in a common blower fan, a large amount of air is not expected to be sucked in through the lower air inlet in the first to third regions. In the blower fan 1 according to the present preferred embodiment, the connection portion 241 is drawn out downwardly of the lower plate 211 in the third region 83 where a large amount of air is not expected to be sucked in. Therefore, the connection portion 241 does not significantly affect the amount of air sucked in through the lower air inlet 211*a*. Moreover, since the connection portion 241 is drawn out downwardly of the lower plate 211 through the lower air inlet 211*a*, the lower plate 211 does not need to include an additional hole through which the connection portion 241 is to be drawn out. Note that, although the connection portion 241 is drawn out in the third region 83 according to the present preferred embodiment, the connection portion 241 may be drawn out in the first or second region 81 or 82. In short, the connection portion 241 is drawn out downwardly of the lower plate 211 through the lower air inlet 211*a* in one of the first to third regions 81, 82, and 83.

Furthermore, in the present preferred embodiment, a portion of the radially inner edge 211*c* of the lower air inlet 211*a* which is near a position where the connection portion 241 is drawn out is arranged to extend straight in a direction substantially perpendicular to a straight line extending from the central axis J1. This contributes to reducing the likelihood that the connection portion 241 will become slack. This in turn contributes to preventing an interference of the connection portion 241 with an air current and a resulting increase in noise. Out of the air inlet portions 211*a*' of the lower air inlet 211*a*, the air inlet portion 211*a*' through which the connection portion 241 is drawn out is arranged to have a minimum radial width near the position where the connection portion 241 is drawn out. This contributes to more effectively preventing a slack of the connection portion 241.

Figure 10:
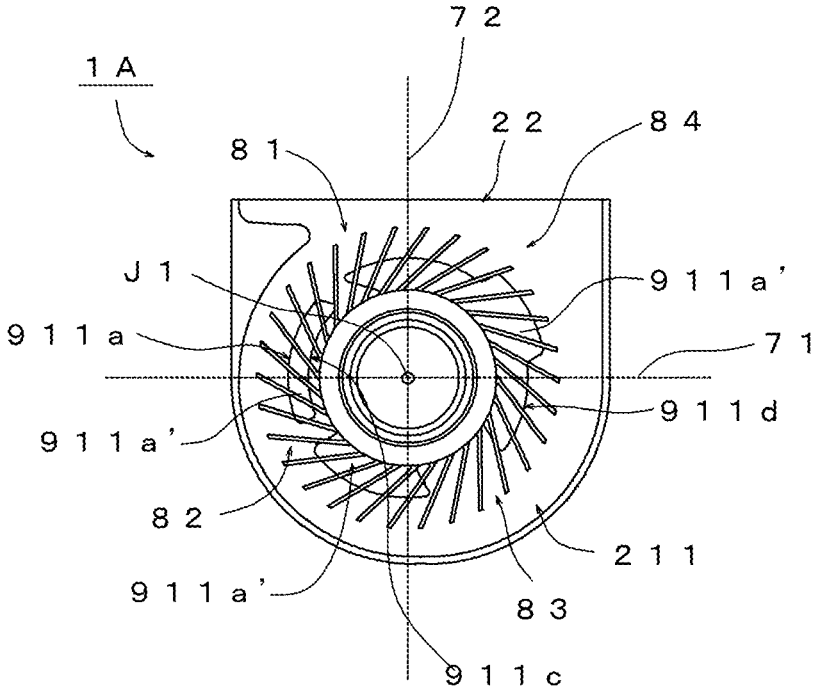
FIG. 10 is a plan view of a blower fan according to another preferred embodiment of the present invention.
Figure 11:
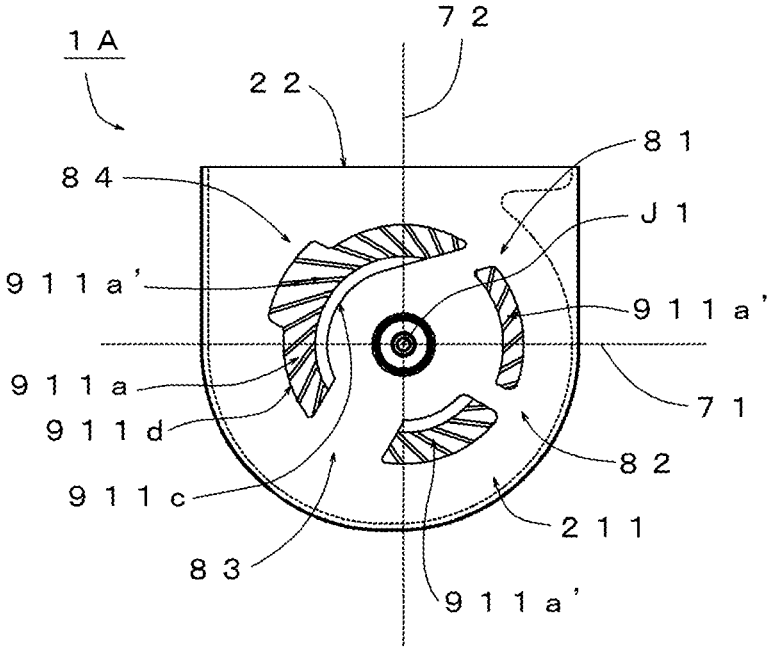
FIG. 11 is a bottom view of the blower fan according to this other preferred embodiment.

FIG. 10 is a plan view of a blower fan 1A according to another preferred embodiment of the present invention. FIG. 11 is a bottom view of the blower fan 1A. Members or portions of the blower fan 1A which have their equivalents in the blower fan 1 are appropriately denoted by the same reference numerals as those of their equivalents in the blower fan 1, and redundant description is omitted. For the sake of convenience, an upper plate and a circuit board are not shown in each of FIGS. 10, 11, and 12 as well.

Referring to FIGS. 10 and 11, a lower plate 211 includes a substantially annular lower air inlet 911*a* arranged to pass through the lower plate 211 in the vertical direction. A radially inner edge 911*c* of the lower air inlet 911*a* is a substantially annular radially inner edge. A radially outer edge 911*d* of the lower air inlet 911*a* is a substantially annular radially outer edge. The substantially annular lower air inlet 911*a* of the blower fan 1A may also be considered to be a collection of a plurality of air inlet portions 911*a*' each of which is substantially in the shape of a circular arc and which are arranged in the circumferential direction. In a plan view, a portion of the radially outer edge 911*d* of the air inlet portion 911*a*' having a portion thereof arranged in the fourth region 84 is arranged to project radially outward away from the central axis J1. In the blower fan 1A, the radial distance between the central axis J1 and the radially outer edge 911*d* of the lower air inlet 911*a* is thereby arranged to be longest in the fourth region 84 out of the first to fourth regions 81, 82, 83, and 84. The amount of air sucked in the fourth region 84 is accordingly increased. This overcomes the problem of a limited amount of air discharged through the air outlet 22 in the first region 81, leading to an increased air volume of the blower fan 1A.

Moreover, in the blower fan 1A, the radial distance between the central axis J1 and the radially inner edge 911*c* of the lower air inlet 911*a* is longest in the first region 81. The total area of openings of the lower air inlet 911*a* in the first region 81, where a large amount of air is not expected to be sucked in, is thereby decreased in the blower fan 1A according to the present preferred embodiment. This contributes to securing a sufficient rigidity of the lower plate 211 while reducing a decrease in the air volume. As a result, the blower fan 1A is able to achieve a more effective reduction in noise.

Figure 12:
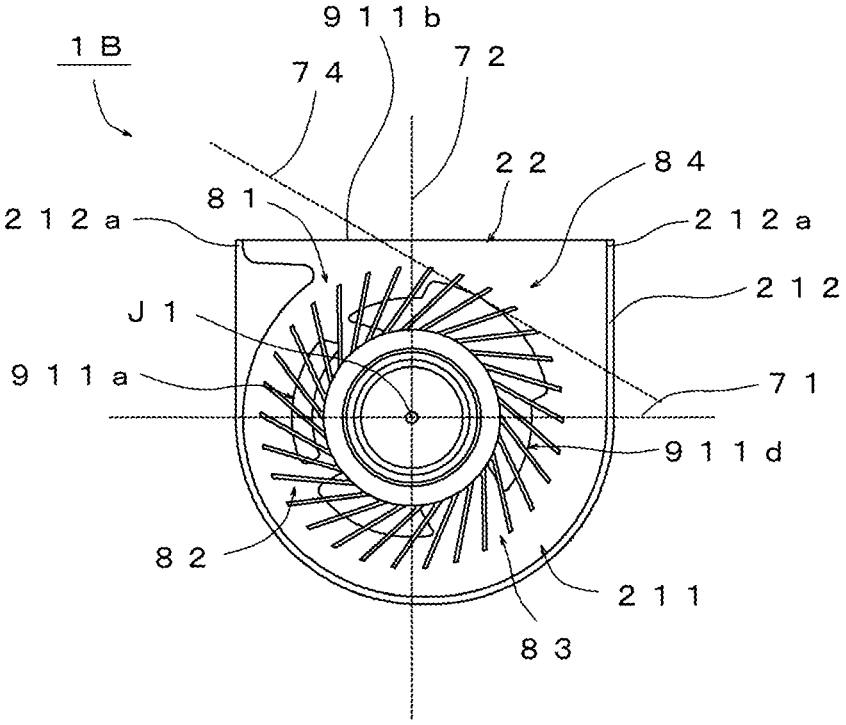
FIG. 12 is a plan view of a blower fan according to yet another preferred embodiment of the present invention.

FIG. 12 is a plan view of a blower fan 1B according to yet another preferred embodiment of the present invention. A chain line 74 illustrated in FIG. 12 is a tangent 74 to a radially outer edge 911*d* at a point where the radial distance between the central axis J1 and the radially outer edge 911*d* is longest in a plan view of the blower fan 1B. A lower plate 911 includes an edge 911*b* extending between edges 212*a* of a side wall portion 212 at both ends thereof. The tangent 74 crosses the edge 911*b* of the lower plate 911 in the first region 81, the edge 911*b* defining a portion of an air outlet 22. That is, in a plan view, the tangent 74 crosses the edge 911*b* which defines a portion of the air outlet 22 in the first region 81. This enables an air sucked in through a lower air inlet 911*a* at a position where the radial distance between the central axis J1 and the radially outer edge 911*d* is longest in the fourth region 84 to be efficiently sent into the first region 81.

Figure 13:
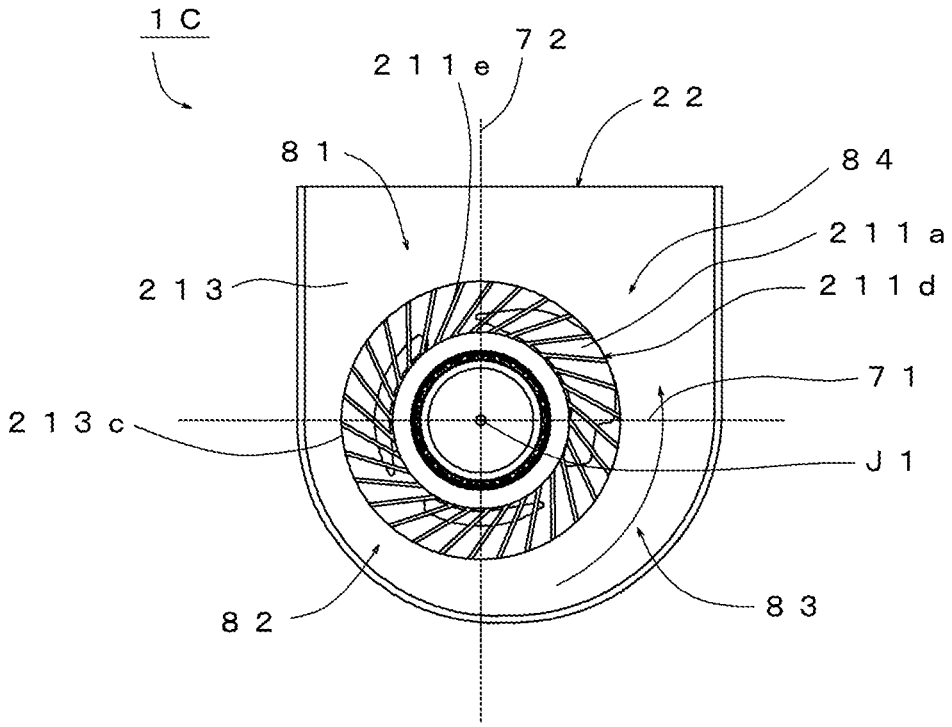
FIG. 13 is a plan view of a blower fan according to yet another preferred embodiment of the present invention.

FIG. 13 is a plan view of a blower fan 1C according to yet another preferred embodiment of the present invention. In the present preferred embodiment, the circumferential position of a point on an edge 213*c* of an upper air inlet 213*a* where the distance between the edge 213*c* of the upper air inlet 213*a* and the central axis J1 is longest is arranged to axially coincide with the circumferential position of a point on a radially outer edge 211*d* of a lower air inlet 211*a* in the fourth region 84 where the distance between the radially outer edge 211*d* and the central axis J1 is longest. In each of the first to third regions 81, 82, and 83, the radial distance between the central axis J1 and the edge 213*c* of the upper air inlet 213*a* is arranged to be longer than the radial distance between the central axis J1 and the radially outer edge 211*d* of the lower air inlet 211*a*. In other words, the radial distance between the central axis J1 and the radially outer edge 211*d* of the lower air inlet 211*a* is arranged to be shorter than the radial distance between the central axis J1 and the edge 213*c* of the upper air inlet 213*a* in each of the first to third regions 81, 82, and 83.

In a common blower fan including a lower air inlet, an increase in the size of the lower air inlet leads to an increase in the flow velocity of an air current passing an edge of the lower air inlet. This results in an increase in noise caused by air currents interfering with a radially inner edge and a radially outer edge of the lower air inlet and edges of ribs. In the present preferred embodiment, since the radial distance between the central axis J1 and the radially outer edge 211*d* of the lower air inlet 211*a* is shorter than the radial distance between the central axis J1 and the edge 213*c* of the upper air inlet 213*a* in each of the first to third regions 81, 82, and 83, a reduction in noise is achieved. Moreover, the total area of an opening of the lower air inlet 211*a* in the fourth region 84 is arranged to be larger than the total area of an opening(s) of the lower air inlet 211*a* in each of the first to third regions 81, 82, and 83 to ensure a sufficient amount of air sucked in through the lower air inlet 211*a*.

While preferred embodiments of the present invention have been described above, it will be understood that the present invention is not limited to the above-described preferred embodiments.

Note that, although the lower air inlet 211*a* is arranged in each of the first to fourth regions 81, 82, 83, and 84 in each of the above-described preferred embodiments, the lower air inlet 211*a* may be arranged only in the fourth region 84. As long as the radial distance between the central axis J1 and the radially outer edge 211*d* of the lower air inlet 211*a* is arranged to be longest in the fourth region 84, no portion of the lower air inlet 211*a* may be arranged in any of the first to third regions 81, 82, and 83.

Figure 14:
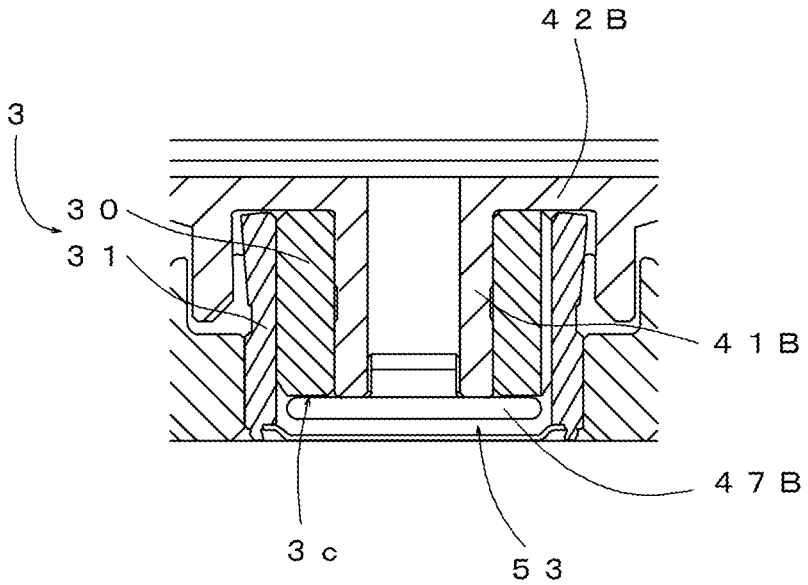
FIG. 14 is a cross-sectional view of a bearing portion and its vicinity of a blower fan according to yet another preferred embodiment of the present invention.

For example, referring to FIG. 14, a thrust dynamic pressure bearing portion 3*c* may be defined by an upper surface of a thrust plate 47B arranged to extend radially outward from a lower end portion of a shaft 41B and a surface of a bearing portion which faces downward and which is axially opposed to the thrust plate 47B. That is, it is enough that axially opposed surfaces of the bearing portion and the rotating portion and a lubricating oil 5 arranged in a thrust gap defined therebetween should be arranged to together define a thrust dynamic pressure bearing portion arranged to generate a fluid dynamic pressure in the lubricating oil 5 in the thrust gap. Note that the shaft 41B and the thrust plate 47B may be defined by either a single member or separate members. In the case where a rotor hub 42B and the shaft 41B are defined by a single member, for example, the shaft 41B and the thrust plate 47B are preferably defined by separate members.

Referring to FIG. 14, a bearing portion 3 may be made up of a substantially cylindrical sleeve 30 made of a sintered metal and a sleeve housing 31 which has a bottom and is substantially cylindrical and which is arranged to cover the sleeve 30.

Note that the lower plate 211 may be arranged to directly hold the bearing portion 3. That is, although the lower plate 211 is arranged to indirectly hold the bearing portion 3 through the bushing 25 in each of the above-described preferred embodiments, this is not essential to the present invention.

Note that the detailed shape of any member may be different from the shape thereof as illustrated in the accompanying drawings of the present application. Also note that features of the above-described preferred embodiments and the modifications thereof may be combined appropriately as long as no conflict arises.

What is claimed is:

1. A blower fan comprising:

a stationary portion;

a bearing portion; and a rotating portion supported by the bearing portion to be rotatable with respect to the stationary portion; wherein the rotating portion includes:

a shaft arranged to extend along a central axis extending in a vertical direction, and inserted in the bearing portion;

a blade support portion arranged radially outward of the shaft, and arranged to rotate about the central axis together with the shaft; and a plurality of blades arranged in an annular shape radially outside the blade support portion, and arranged to rotate about the central axis together with the shaft;

the stationary portion includes:

a lower plate arranged to cover the blades from below, and arranged to hold the bearing portion directly or indirectly;

an upper plate arranged to cover the blades from above; and a side wall portion arranged to cover the blades from radially outside, and having a lower end portion fixed to the lower plate;

edges of the side wall portion at both ends of an opening of the side wall portion, an edge of the upper plate which extends between the edges of the side wall portion, and an edge of the lower plate which extends between the edges of the side wall portion are arranged to together define an air outlet;

an inside surface of the bearing portion, an outside surface of the shaft, and a lubricating oil arranged in a radial gap defined between the inside surface of the bearing portion and the outside surface of the shaft are arranged to together define a radial dynamic pressure bearing portion arranged to generate a fluid dynamic pressure in the lubricating oil;

axially opposed surfaces of the bearing portion and the rotating portion and the lubricating oil arranged in a thrust gap defined between these surfaces are arranged to together define a thrust dynamic pressure bearing portion arranged to generate a fluid dynamic pressure in the lubricating oil in the thrust gap;

the lower plate includes a lower air inlet arranged to pass through the lower plate in the vertical direction, and arranged radially outward of the bearing portion;

the upper plate includes an upper air inlet arranged to pass through the upper plate in the vertical direction;

an inside surface of the side wall portion includes a tongue portion where a radial distance between the inside surface of the side wall portion and any of the blades is shortest;

in a plan view, a plane is divided into four regions by a first straight line which is parallel to the air outlet and crosses the central axis and a second straight line which is perpendicular to the air outlet and crosses the central axis, and one of the four regions in which the tongue portion is arranged is a first region, followed by a second region, a third region, and a fourth region in this order in a rotation direction of the blades;

the air outlet is arranged to extend over both the first and fourth regions;

at least a portion of the lower air inlet is arranged in the fourth region; and a radial distance between the central axis and a radially outer edge of the lower air inlet is arranged to be longest in the fourth region, wherein a circumferential position of a point on an edge of the upper air inlet where a distance between the edge of the upper air inlet and the central axis is longest in the fourth region is arranged to axially coincide with a circumferential position of a point on the radially outer edge of the lower air inlet where a distance between the radially outer edge of the lower air inlet and the central axis is longest in the fourth region.

2. The blower fan according to claim 1, wherein the lower air inlet includes a portion or portions arranged in at least one of the first to third regions.

3. The blower fan according to claim 2, wherein the lower air inlet is made up of a collection of a plurality of air inlet portions arranged in a circumferential direction;

the air inlet portions include a first air inlet portion having at least a portion thereof arranged in the fourth region; and the first air inlet portion is arranged to have a greatest circumferential dimension of all the air inlet portions.

4. The blower fan according to claim 2, wherein the lower air inlet includes a portion extending over both the third and fourth regions.

5. The blower fan according to claim 3, wherein the first air inlet portion is arranged to extend over both the third and fourth regions.

6. The blower fan according to claim 2, wherein the lower air inlet includes a portion extending over both the first and fourth regions.

7. The blower fan according to claim 3, wherein the first air inlet portion is arranged to extend over both the first and fourth regions.

8. The blower fan according to claim 7, wherein the tongue portion includes a proximity point where the tongue portion is closest to an outer end portion of any of the blades;

in the plan view, the plane is divided into two regions by a third straight line which joins the proximity point and the central axis, and one of the two regions in which the tongue portion is arranged is a fifth region while the other region is a sixth region; and an end portion of the first air inlet portion on a forward side in the rotation direction is arranged in the sixth region.

9. The blower fan according to claim 1, wherein both an edge of the upper air inlet and the radially outer edge of the lower air inlet are arranged radially inward of a radially outer end portion of each of the blades.

10. The blower fan according to claim 2, wherein both an edge of the upper air inlet and the radially outer edge of the lower air inlet are arranged radially inward of a radially outer end portion of each of the blades.

11. The blower fan according to claim 3, wherein both an edge of the upper air inlet and the radially outer edge of the lower air inlet are arranged radially inward of a radially outer end portion of each of the blades.

12. The blower fan according to claim 2, wherein the stationary portion further includes a stator;

the stator includes:

an annular core back;

a plurality of teeth arranged to project radially outward from the core back; and coils each of which is defined by a conducting wire wound around a separate one of the teeth;

the stationary portion further includes a circuit board arranged on an upper surface of the lower plate, and arranged to have lead wires from the coils electrically connected thereto;

the circuit board includes a connection portion arranged to be connected with an external device; and the connection portion is drawn out downwardly of the lower plate through the lower air inlet in one of the first to third regions.

13. The blower fan according to claim 3, wherein the stationary portion further includes a stator;

the stator includes:

an annular core back;

a plurality of teeth arranged to project radially outward from the core back; and coils each of which is defined by a conducting wire wound around a separate one of the teeth;

the stationary portion further includes a circuit board arranged on an upper surface of the lower plate, and arranged to have lead wires from the coils electrically connected thereto;

the circuit board includes a connection portion arranged to be connected with an external device; and the connection portion is drawn out downwardly of the lower plate through the lower air inlet in one of the first to third regions.

14. The blower fan according to claim 12, wherein a portion of a radially inner edge of the lower air inlet which is near a position where the connection portion is drawn out is arranged to extend straight in a direction substantially perpendicular to a straight line extending from the central axis.

15. The blower fan according to claim 3, wherein the stationary portion further includes a stator;

the stator includes:

an annular core back;

a plurality of teeth arranged to project radially outward from the core back; and coils each of which is defined by a conducting wire wound around a separate one of the teeth;

the stationary portion further includes a circuit board arranged on an upper surface of the lower plate, and arranged to have lead wires from the coils electrically connected thereto;

the circuit board includes a connection portion arranged to be connected with an external device;

the connection portion is drawn out downwardly of the lower plate through one of the air inlet portions of the lower air inlet in one of the first to third regions; and the air inlet portion through which the connection portion is drawn out is arranged to have a minimum radial width near a position where the connection portion is drawn out.

16. The blower fan according to claim 1, wherein, in each of the first to third regions, the radial distance between the central axis and the radially outer edge of the lower air inlet is arranged to be shorter than a radial distance between the central axis and the edge of the upper air inlet.

17. The blower fan according to claim 1, wherein, in the plan view, a tangent to the radially outer edge of the lower air inlet at a point where the radial distance between the central axis and the radially outer edge of the lower air inlet is longest is arranged to cross both the edges of the upper and lower plates in the first region, the edges of the upper and lower plates defining the air outlet.

18. The blower fan according to claim 2, wherein, in the plan view, a tangent to the radially outer edge of the lower air inlet at a point where the radial distance between the central axis and the radially outer edge of the lower air inlet is longest is arranged to cross both the edges of the upper and lower plates in the first region, the edges of the upper and lower plates defining the air outlet.

19. The blower fan according to claim 3, wherein, in the plan view, a tangent to the radially outer edge of the lower air inlet at a point where the radial distance between the central axis and the radially outer edge of the lower air inlet is longest is arranged to cross both the edges of the upper and lower plates in the first region, the edges of the upper and lower plates defining the air outlet.

* * * * *